US006698516B2

(12) United States Patent
Van Steenwyk et al.

(10) Patent No.: US 6,698,516 B2
(45) Date of Patent: Mar. 2, 2004

(54) METHOD FOR MAGNETIZING WELLBORE TUBULARS

(75) Inventors: Donald H. Van Steenwyk, San Marino, CA (US); James N. Towle, Seattle, WA (US)

(73) Assignee: Scientific Drilling International, Houston, TX (US)

( * ) Notice: Subject to any disclaimer, the term of this patent is extended or adjusted under 35 U.S.C. 154(b) by 0 days.

(21) Appl. No.: 10/071,763

(22) Filed: Feb. 6, 2002

(65) Prior Publication Data

US 2002/0112856 A1 Aug. 22, 2002

Related U.S. Application Data

(60) Provisional application No. 60/268,958, filed on Feb. 16, 2001.

(51) Int. Cl.[7] ..... E21B 43/00; E21B 47/09

(52) U.S. Cl. ..... 166/255.2; 166/66.5; 166/243; 166/381; 125/45

(58) Field of Search ..... 166/250.1, 255.2, 166/255.1, 254.1, 254.2, 380, 381, 66.5, 65.1, 242.1, 242.4, 243; 125/45, 61; 324/346, 221

(56) References Cited

U.S. PATENT DOCUMENTS

| | | | | | |
|---|---|---|---|---|---|
| 3,277,636 | A | * | 10/1966 | Schuster | 96/119 |
| 3,539,915 | A | * | 11/1970 | Walters et al. | 324/220 |
| 3,725,777 | A | | 4/1973 | Robinson et al. | |
| 3,940,689 | A | * | 2/1976 | Johnson, Jr. | 324/221 |
| 4,072,200 | A | | 2/1978 | Morris et al. | |
| 4,292,588 | A | * | 9/1981 | Smith | 324/221 |
| 4,372,398 | A | * | 2/1983 | Kuckes | 175/45 |
| 4,443,762 | A | | 4/1984 | Kuckes | |
| 4,458,767 | A | | 7/1984 | Hoehn, Jr. | |
| 4,465,140 | A | | 8/1984 | Hoehn, Jr. | |
| 4,510,447 | A | * | 4/1985 | Moyer | 324/225 |
| 4,593,770 | A | | 6/1986 | Hoehn, Jr. | |
| 4,933,640 | A | * | 6/1990 | Kuckes | 324/339 |
| 5,230,387 | A | | 7/1993 | Waters et al. | |
| 5,351,755 | A | | 10/1994 | Howlett | |
| 5,512,830 | A | | 4/1996 | Kuckes | |
| 5,541,517 | A | | 7/1996 | Hartmann et al. | |
| 5,646,533 | A | * | 7/1997 | Locatelli et al. | 324/339 |
| 5,914,596 | A | | 6/1999 | Weinbaum | |
| 6,369,679 | B1 | * | 4/2002 | Cloutier et al. | 335/284 |

FOREIGN PATENT DOCUMENTS

| | | | | |
|---|---|---|---|---|
| EP | 0301671 A2 | * | 1/1989 | E21B/47/022 |
| WO | WO 95/07331 | | 3/1995 | |
| WO | WO 02/066784 A1 | * | 8/2002 | E21B/23/00 |

OTHER PUBLICATIONS

J. D. Robinson, J. P. Vogiatzis, "Magnetostatic Methods for Estimating Distance and Direction from a Relief Well to a Cased Wellbore".

John I. De Lange, Toby J. Darling, "Improved Detectability of Blowing Wells".

* cited by examiner

*Primary Examiner*—David Bagnell
*Assistant Examiner*—Jennifer H Gay
(74) *Attorney, Agent, or Firm*—William W. Haefliger

(57) ABSTRACT

In the method of providing for well tubular member magnetization, the steps include providing a magnetizing structure comprising an electrical coil defining an axis, relatively displacing the member and the structure, with the coil positioned and guided in close, centered proximity to the member, while supplying electric current to flow in the coil, thereby creating magnetic flux passage through the member and core to magnetize the member, or a part of the member, and displacing the member in a wellbore.

2 Claims, 8 Drawing Sheets

METHOD FOR MAGNETIZING WELLBORE TUBULARS

This application is a non-provisional application based on provisional application Ser. No. 60/268,958, filed Feb. 16, 2001.

BACKGROUND OF THE INVENTION

This invention relates to a method for accurate magnetization of tubular wellbore members such as casing segments or drill string segments. Such magnetization produces a remanent magnetic flux that extends at a distance or distances from the wellbore member, about that member, to facilitate detection of such a tubular member in a borehole when drilling another borehole, for example in an attempt to intercept the borehole containing the magnetized wellbore member.

The prior art discloses methods to determine the location and attitude of a source of magnetic interference such as a magnetized wellbore tubular having a remanent magnetic field. In this regard, U.S. Pat. No. 3,725,777 which describes a method to determine the earth's field from a magnetic compass and total field measurements, and then calculate the deviations, due to the external source of magnetic interference. The magnetic field of a long cylinder is then fitted to the magnetic deviations in a least-squares sense. That '777 patent, and the paper "Magnetostatic Methods for Estimating Distance and Direction from a Relief Well to a Cased Wellbore", describe the source of the remanent magnetic field. The '377 patent states, at column 1, lines 33 to 41 that "To have a remanent magnetization in the casing is not difficult since most well casing is electromagnetically inspected before it is installed. The electromagnetic inspection leaves a remanent magnetization in the casing. Since casing is normally installed in individual sections that are joined together, the remanent magnetization of unperturbed casing is normally periodic."

U.S. Pat. No. 4,072,200 and related U.S. Pat. No. 5,230,387 disclosed a method whereby the magnetic field gradient is measured along a wellbore for the purpose of locating a nearby magnetic object. The gradient is calculated by measuring the difference in magnetic field between two closely spaced measurements; and because the earth field is constant over a short distance, the effect of the earth field is removed from the gradient measurement. The location and attitude of the source external to the drill string can then be determined by comparison with theoretical models of the magnetic field gradient produced by the external source.

U.S. Pat. No. 4,458,767 describes a method by which the position of a nearby well is determined from the magnetic field produced by magnetized sections of casing. U.S. Pat. No. 4,465,140 describes a method for magnetization of well casing. In this method, a magnetic coil structure is traversed through the interior of the casing, which is already installed in the borehole. While traversing the casing, the coil is energized with a direct current which is periodically reversed to induce a desired pattern of magnetization.

European Pat. No. Application GB9409550 discloses a graphical method for locating the axis of a cylindrical magnetic source from borehole magnetic field measurements acquired at intervals along a straight wellbore.

U.S. Pat. No. 5,512,830 describes a method whereby the position of a nearby magnetic well casing is determined by approximating the static magnetic field of the casing by a series of mathematical functions distributed sinusoidally along the casing. In an earlier paper "Improved Detectability of Blowing Wells", John I. DeLange and Toby J. Darling, "SPE Drilling Engineering", Society of Petroleum Engineers, Mar. 1990, pp. 34–38, a method was described whereby the static magnetic field of a casing was approximated by an exponential function.

European Patent Specification 0 031 671 B1 describes a specific method for magnetizing wellbore tubulars by traversing the tubular section in an axial direction through the central opening of an electric coil prior to the installation of the tubular section into a wellbore. Production of opposed magnetic poles having a pole strength of more than 3000 microweber is disclosed.

The above referenced paper "Improved Detectability of Blowing Wells", expresses the need for as high a magnetization as possible in the target tubulars, and states, "Because most magnetometers in use in survey/MWD have a sensitivity of +/_0.2 microTesla, a value of 0.4 microTesla is considered to be a reasonable threshold value." Note that 0.2 microTesla is equivalent to 200 nanoTesla, and that in the patent and the paper, a lower limit to the tubular magnetization, namely 3000 microweber, is described or claimed.

SUMMARY OF THE INVENTION

It is one objective of the present invention to take advantage of improvements in the state of the art of magnetometer measurements to provide a method of magnetization of wellbore tubulars for use in drilling intercept wells that does not require such a high level of magnetization as 3000 microWeber.

The value of 0.4 microTesla cited in the above referenced paper for good detectability of small magnetic field changes was representative of the state of the art in magnetometer measurements at the time of publication of that paper in 1990. The present invention employs a magnetometer sensor and electronics apparatus for borehole use having a 16-bit analog-to-digital converter enabling much higher accuracy and resolution characteristics. This leads to a quantization of about 2 nT (nanoTesla) per bit that in turn leads to a root-mean-square quantization error of about 0.58 nt RMS. Other electrical noise in the system as well as basic magnetometer noise limits the detectability of small changes in magnetic field to about 2 nT with short-term averaging of the measurements. This value, 2 nT, is thus 200 times less than the 400 nT cited in the referenced paper as a "reasonable threshold." Thus, either the range of detection of a magnetic target can be greatly increased for a given magnetization of the target tubular, or the magnetization of the tubular can be substantially reduced from previous values required by prior art.

Reduced required magnetization of the tubular results in reduced size and weight for the magnetizing apparatus, reduced electrical power for the magnetizing apparatus, reduced sideways-directed forces between the magnetizing apparatus and the tubular during magnetizing and reduced magnetic forces between the individual tubular element and other magnetic materials during handling, prior to insertion into the borehole.

The reduced electrical power for the magnetizing apparatus makes it possible, in some embodiments, to measure the magnetic pole strength of the induced magnetization and if desired control the electrical power to achieve a controlled and known level of magnetization. Such a known level of pole strength of the magnetization can lead to improvements in the estimation of range to the target casing in the intercept process.

Accordingly, the method of the invention includes, in some desirable embodiments, either or both:

1. Measuring the induced pole strength of the induced magnetization in the tubular element;
2. Measuring the induced pole strength of the induced magnetization in the tubular and using such measured pole strength, in feedback relation with the electrical power of the magnetizing apparatus, to control the magnetization to a desired level, in the tubular element.

It has been well known since 1971, the filing date for U.S. Pat. No. 3,725,777, that a useful remanent magnetic field in wellbore tubulars can be obtained as a by-product of magnetic inspection of the tubular prior to installing the tubular in a borehole, such inspection involving applying a magnetic field to the tubular element. This invention expands on that knowledge by describing how specific requirements on magnetic field values during the inspection process can produce the desired levels of magnetic pole strength for the tubular, without requiring a separate specific apparatus or procedure following magnetic inspection.

Major objects of the invention include providing for well tubular member magnetization, by carrying out the following steps:

a) providing a magnetizing structure comprising an electrical coil defining an axis, b) relatively displacing said tubular member and said structure, with said coil positioned and guided in close, proximity to said member, and while supplying electric current to flow in the coil, thereby creating magnetic flux passage through said tubular member and core to magnetize that member, or a part of that member, c) and displacing said tubular member in a wellbore.

In that method, the coil may remain positioned either externally or internally of the member during such relative displacing of the member and structure. Further, a spacer element or elements, as for example a roller or rollers, may be provided for spacing the coil from the tubular member during such relative displacing of the member and structure.

Additional objects including providing flux passing pole pieces at opposite ends of the coil; measuring the magnetic pole strength of the magnetic field produced proximate the end or ends of said member, by said flux passage; and controlling a parameter of the flux as a function of such measuring; and magnetizing the tubular member to a pole strength less than about 2,500 microWeber.

Further, the method includes and facilitates magnetically detecting the presence of the member in the wellbore, from a location outside the bore and spaced therefrom by underground formation. Also, the method may include providing a magnetic measurement device, and displacing that device within said member in the wellbore while operating the device to enhance magnetization of the member, in the well.

The tubular member may comprise any of the following:

i) a well casing section ii) well tubing iii) drill pipe.

These and other objects and advantages of the invention, as well as the details of an illustrative embodiment, will be more fully understood from the following specification and drawings, in which:

DRAWING DESCRIPTION

Figure 6A:
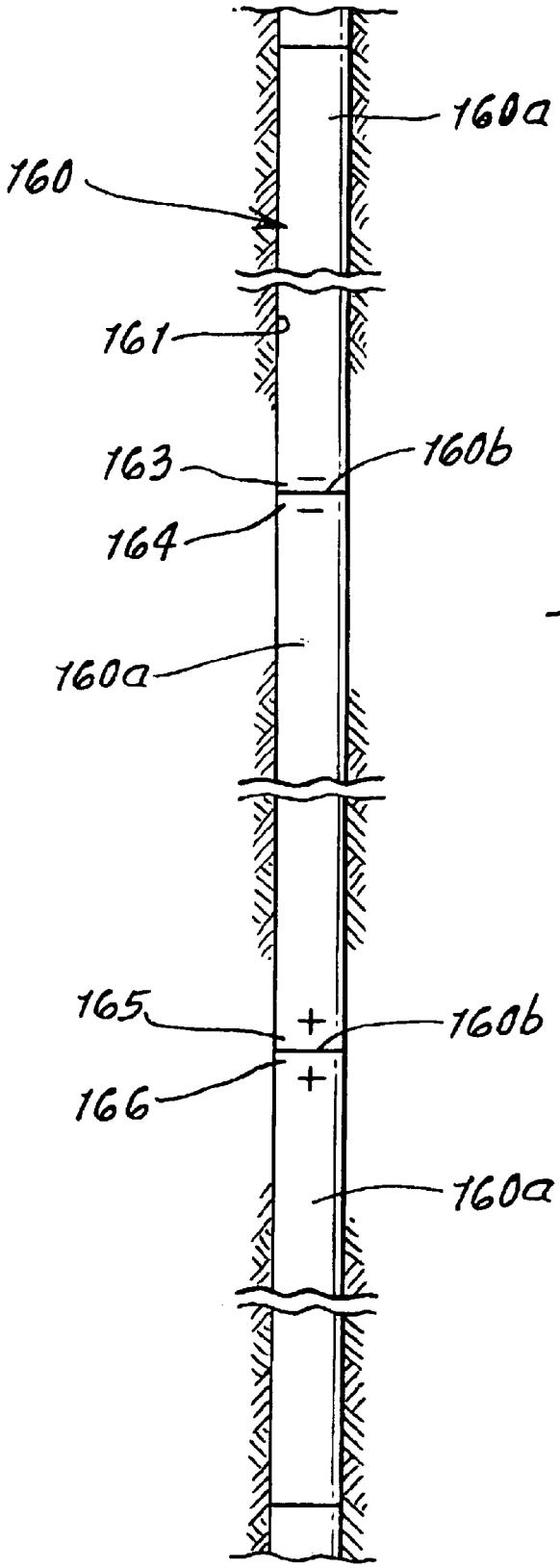
Figure 6B:
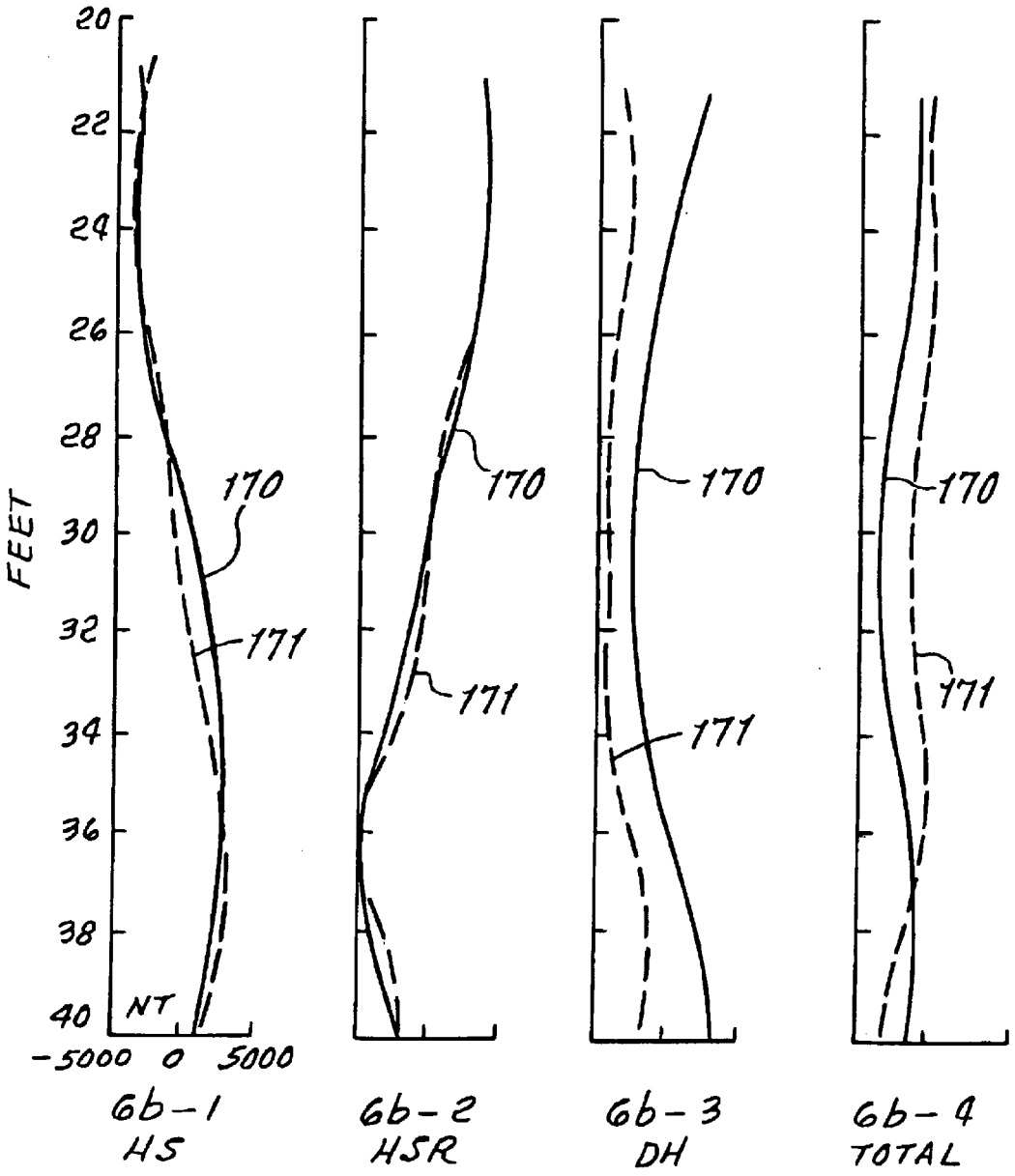
Figure 7:
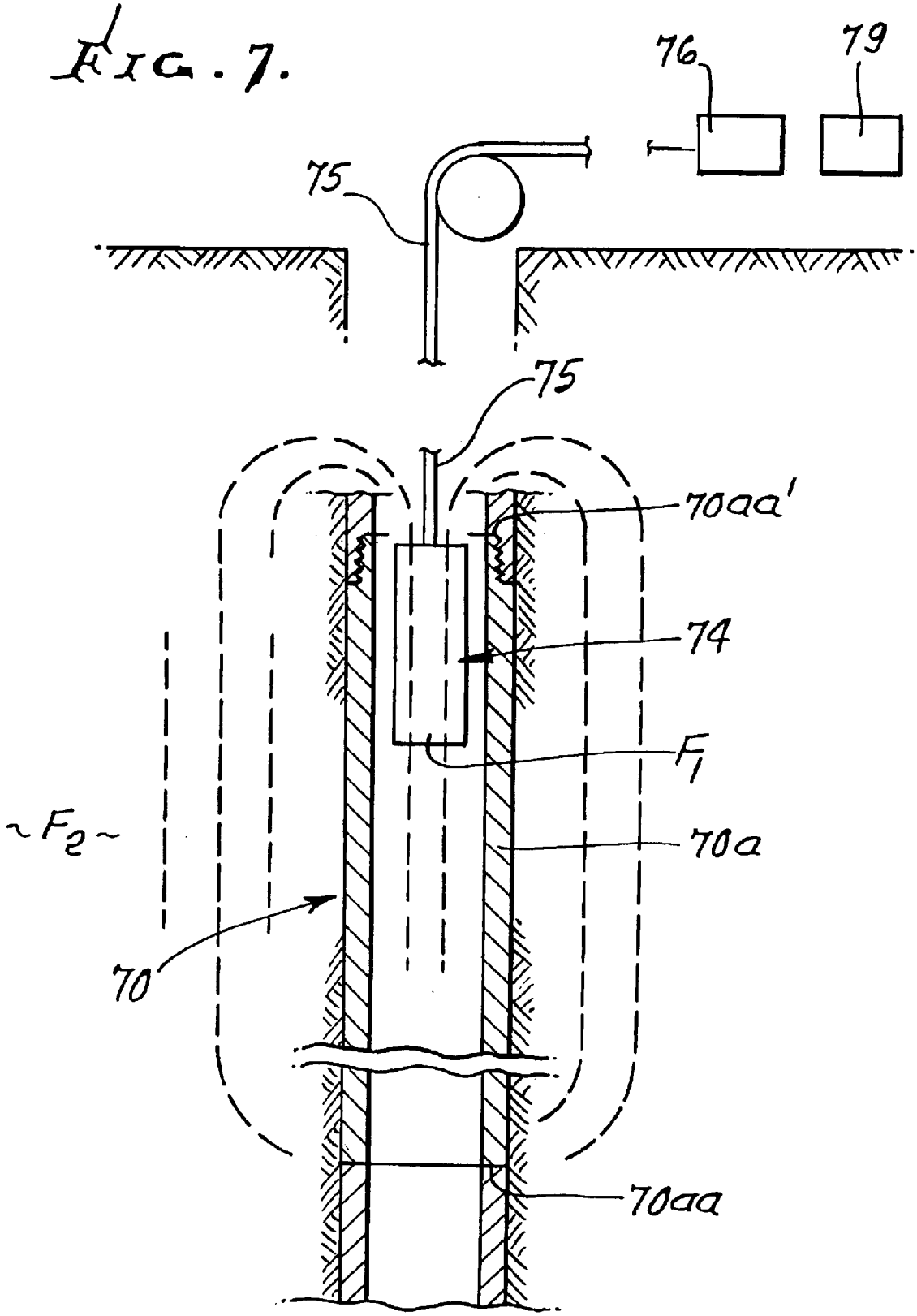

FIG. 6*a* shows magnetized tubular members connected in a string;

FIG. 6*b* is a diagram showing magnetic measurements with a magnetized tubular member; and FIG. 7 is a section showing a method of use.

DETAILED DESCRIPTION

Figure 1:
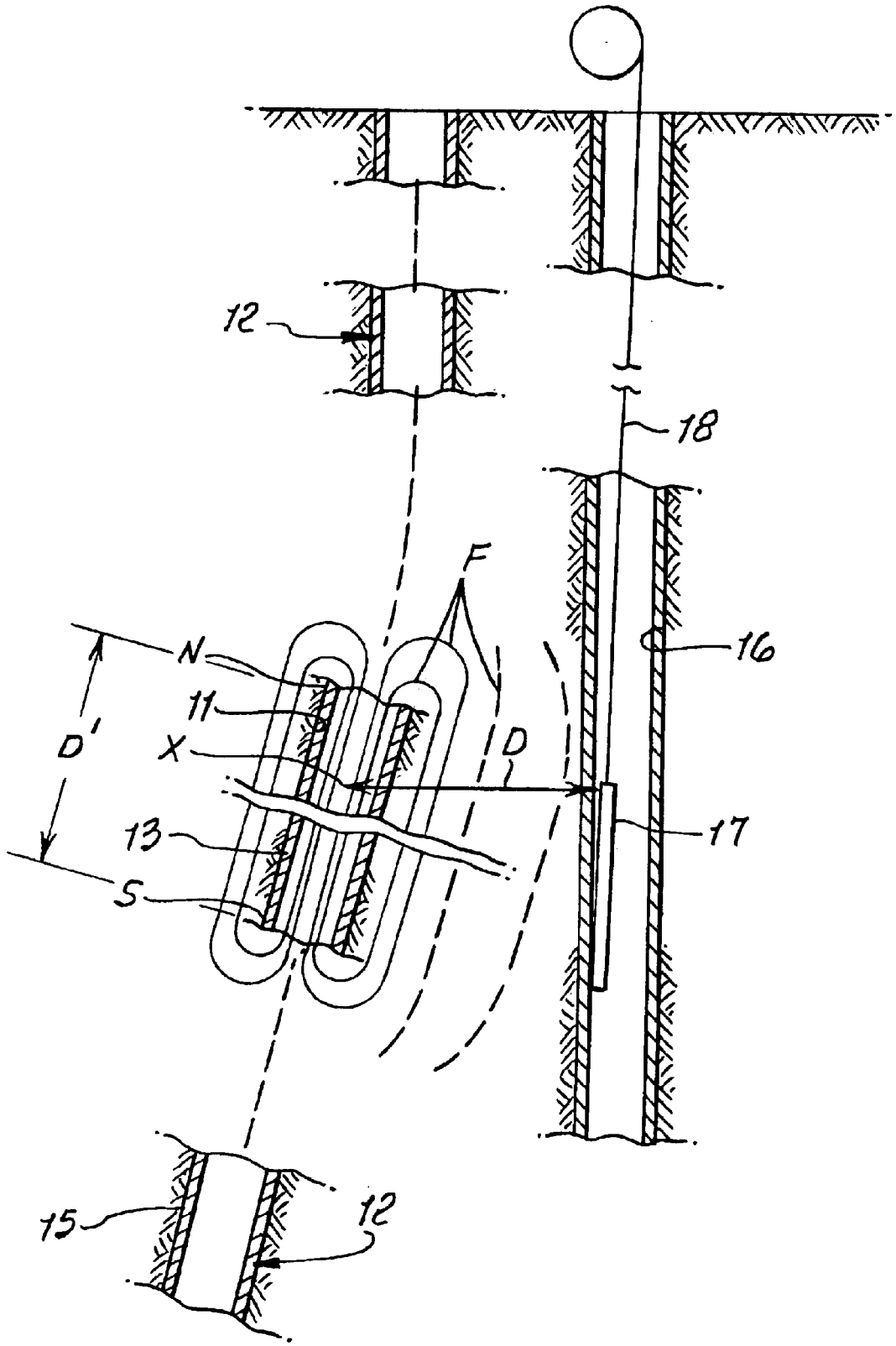
FIG. 1 shows a cross-section of a wellbore in the earth having a casing and a magnetized section of casing.

FIG. 1 shows a target borehole 11 having in it a casing string 12 which contains a casing section 13 which has been magnetized axially to provide a suitable target region in the target borehole. As shown, the casing section 13 is installed above a non-magnetic, or non-magnetized, section 15 and below other sections above that are also not magnetized. Another borehole 16 is adjacent to the target borehole 11 and it is necessary to determine the location of the magnetic survey tool 17, carried by wire line 18, with respect to the magnetized casing section. The magnetized section 13 has a center marked X and North and South magnetic poles marked N and S. Magnetic field lines F are marked and show the magnetic flux extending into the region or formation outside of borehole 10 that is to be detected. Methods to determine the direction and the distance D from the survey tool 17 to the center of the magnetized section are well known to those skilled in the art of magnetic interception.

Figure 2:
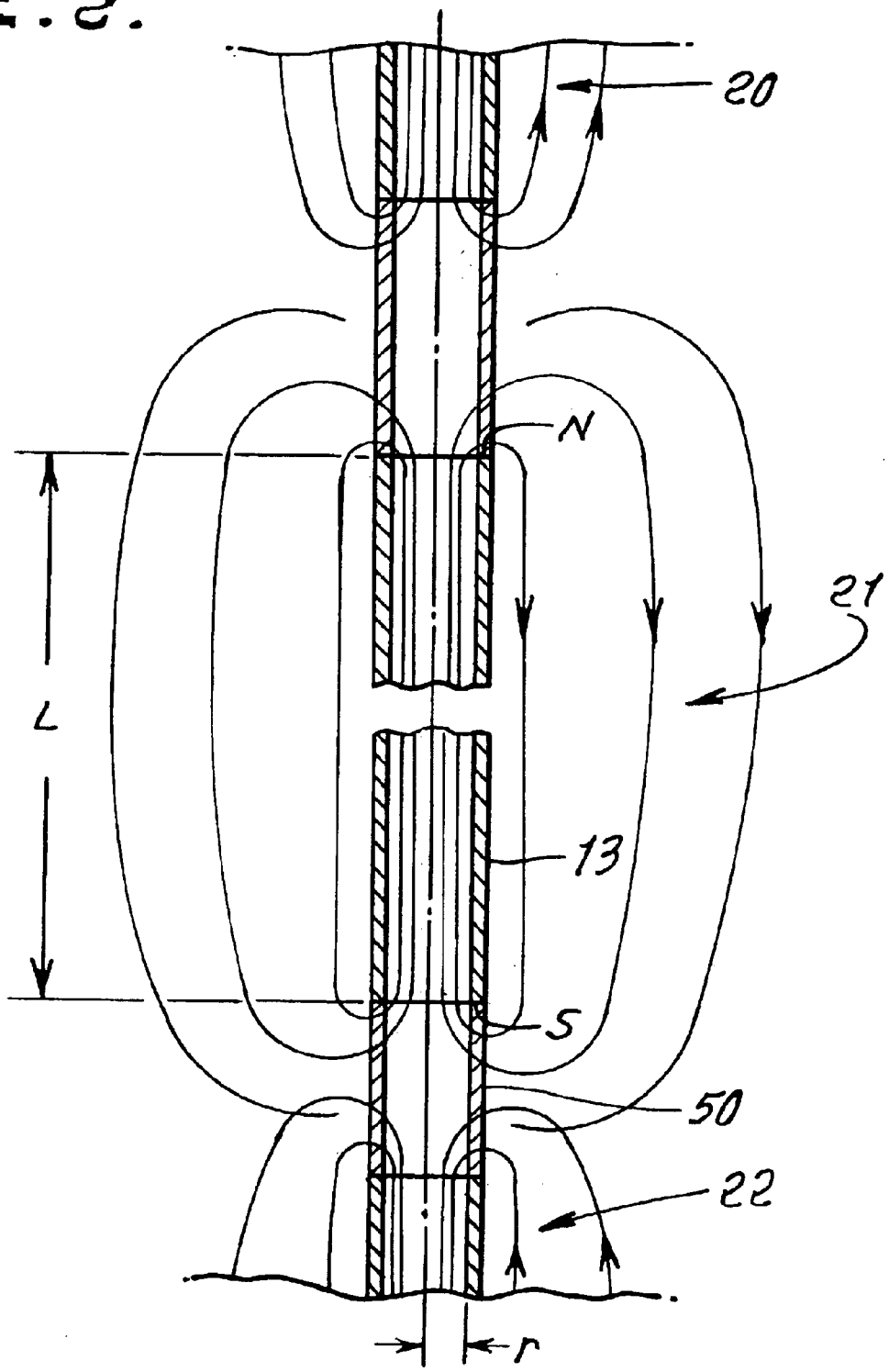
FIG. 2 shows a desired pattern of magnetization for one or more sections of magnetized casing.

FIG. 2 shows an expanded region of a magnetized casing section 13 having a radius r shown from the center line. In this figure, three adjacent sections of magnetization are shown. Note that the upper and lower regions 20 and 22 are of the same magnetic polarity (flux line direction) and that the intermediate section 21 is of the opposite polarity. Any number of sections in a casing string may be magnetized, and such sections may be combined in any desired manner to provide a unique magnetic signature for the casing string. Also, as shown in FIG. 1, non-magnetized sections 50 may be included. The distance D' between the North "N" and South "S" poles is generally some multiple of the length of the individual casing sections. Such casing sections are typically on the order of 30 feet long, so that multiple sections on the order of 30, 60, 90 120 or 150 feet are feasible or reasonable. The range of detection of a section of length L depends both on the strength of the magnetic field and the length of the net magnetic dipole created by the magnetization of section. Typical magnetization results in the type of magnetic field structure shown in FIG. 2.

Figure 3:
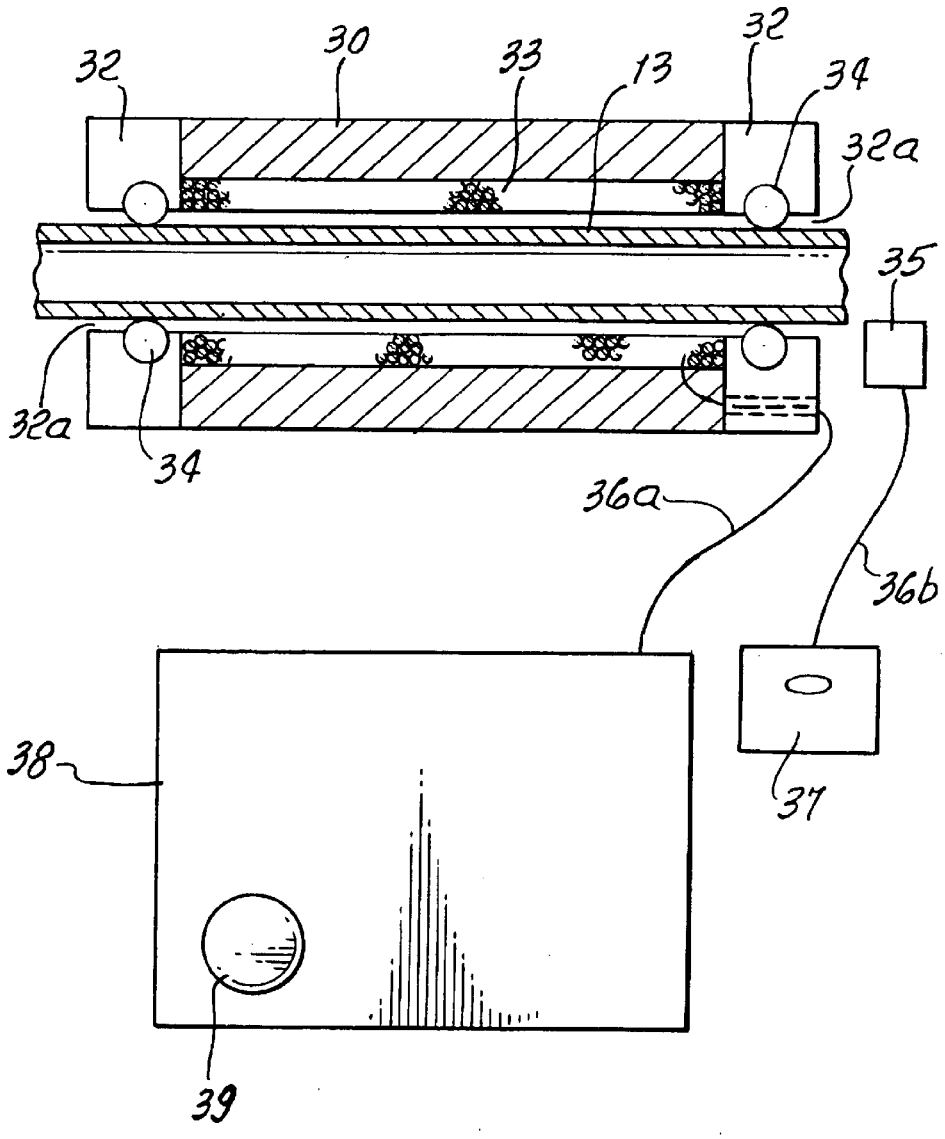
FIG. 3 shows an apparatus for magnetization of a wellbore tubular that has an external magnetizing coil.

FIG. 3 shows one form or method of magnetization, using an external coil structure 30 extending about the casing section 13. The coil structure 30 comprises an electric solenoid coil 33 with windings extending about section 13 to provide the magnetomotive force for the magnetization when supplied with electric current. Pole pieces 32 at each end of the coil can be size adapted for a variety of diameters of the casing section 13. The axial spacing between the pole pieces 32 exceeds the casing section diameter. The magnetic flux created by the coil 33 flows through the pole pieces 32, through the air gaps 32*a* between the pole pieces and the casing section 13 and then returns longitudinally to the other end of the coil through the casing section. The magnetic flux in the air gaps is generally radial. This radial flux creates a force between the pole piece and the casing section. Spacers such as rollers wheels 34 which may be carried by or near pole pieces 32, provide for spacing and/or reduced friction between the pole pieces and the casing. A magnetic flux measuring device 35 is placed to be near one end of the passing casing 13 so that the achieved level of magnetization may be determined. The flux measuring device 35 is connected to a flux indication instrument 37 by wire 36*b*.

A power supply 38 provides a direct electrical current to the coil 33 by means of wire 36*a*. A manual adjustment 39 such as a variable resistance provides a means to select the current level to be applied to the coil. Coil windings extend between pole pieces 32, and are located radially outwardly of elongated air gap 32*a*.

The apparatus shown in FIG. 3 may be used in a number of ways to magnetize the casing section. The casing section 13 can be held immobile with respect to the earth as the coil structure 30 is traversed along the casing section in an axial direction. Alternatively, the coil structure may be held immobile with respect to the earth as the casing section is traversed through the coil structure. If desired, the coil structure may be mounted axially vertically directly above the borehole. In this situation, the casing section can be magnetized as it is being lowered into the borehole.

Figure 4:
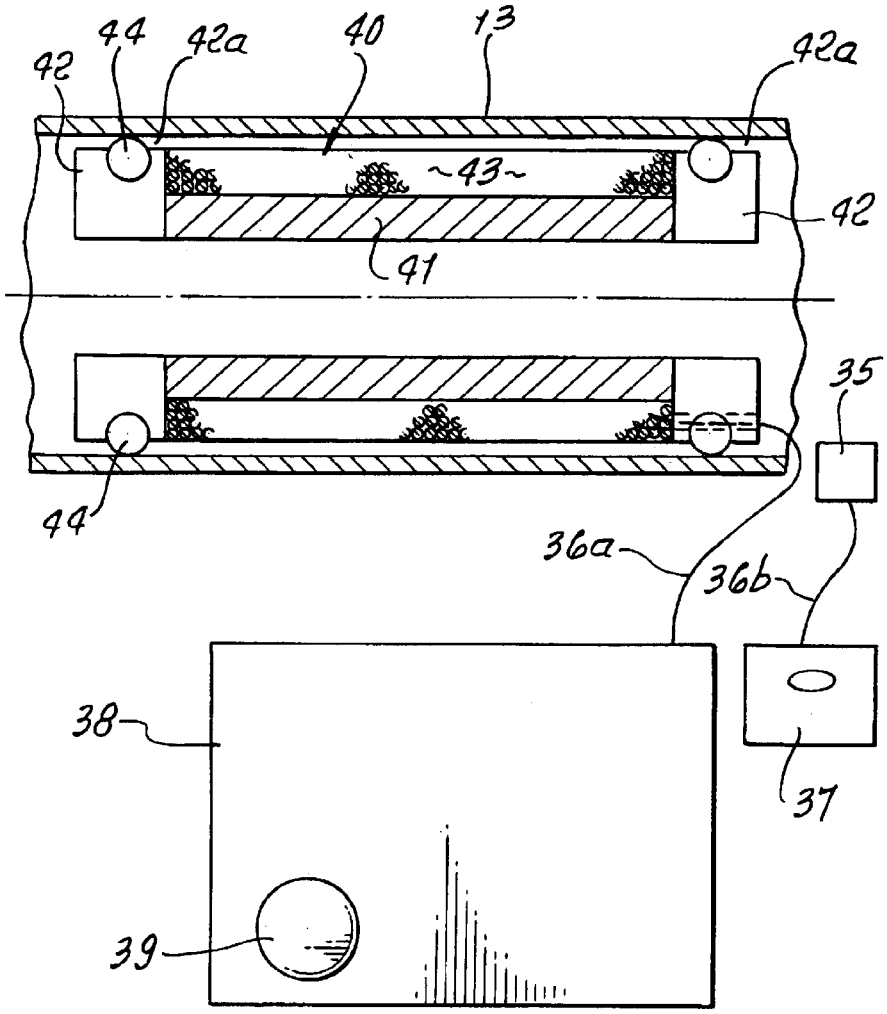
FIG. 4 shows an apparatus for magnetization of a wellbore tubular that has an internal magnetizing coil.

FIG. 4 shows an alternative form of magnetizing coil. This configuration is for use internal to the casing section rather than external to the casing as shown in FIG. 3. Inside the casing segment 13 is an internal coil structure 40. This coil structure comprises a flux passing metallic core 41, shown as axially elongated, two end annular pole pieces 42, and an electric solenoid coil 43 that provides the magnetomotive force for the magnetization when supplied with electric current. The annular pole pieces 42 at each end of the core 41 can be adapted for a variety of diameters of the casing section 13. As in FIG. 3, the magnetic flux created by the coil 43 flows through the core 41, the pole pieces 42, through the air gaps 42*a* between the pole pieces and the casing section, and then returns longitudinally to the other end of the core through the casing section. The magnetic flux in the air gaps is generally radial, and creates a force between the pole piece and the casing segment. Roller wheels 44, carried on or near to 42, provide spacing and/or reduced friction between the pole pieces and the casing section. If the rollers are carried by the pole pieces, changes in the pole piece diameters also change the roller positions to accommodate to different size casing, well tubing or drill pipe. The other elements of FIG. 4, items 35 through 39, are the same as shown and discussed in relation to FIG. 3 above.

Figure 5:
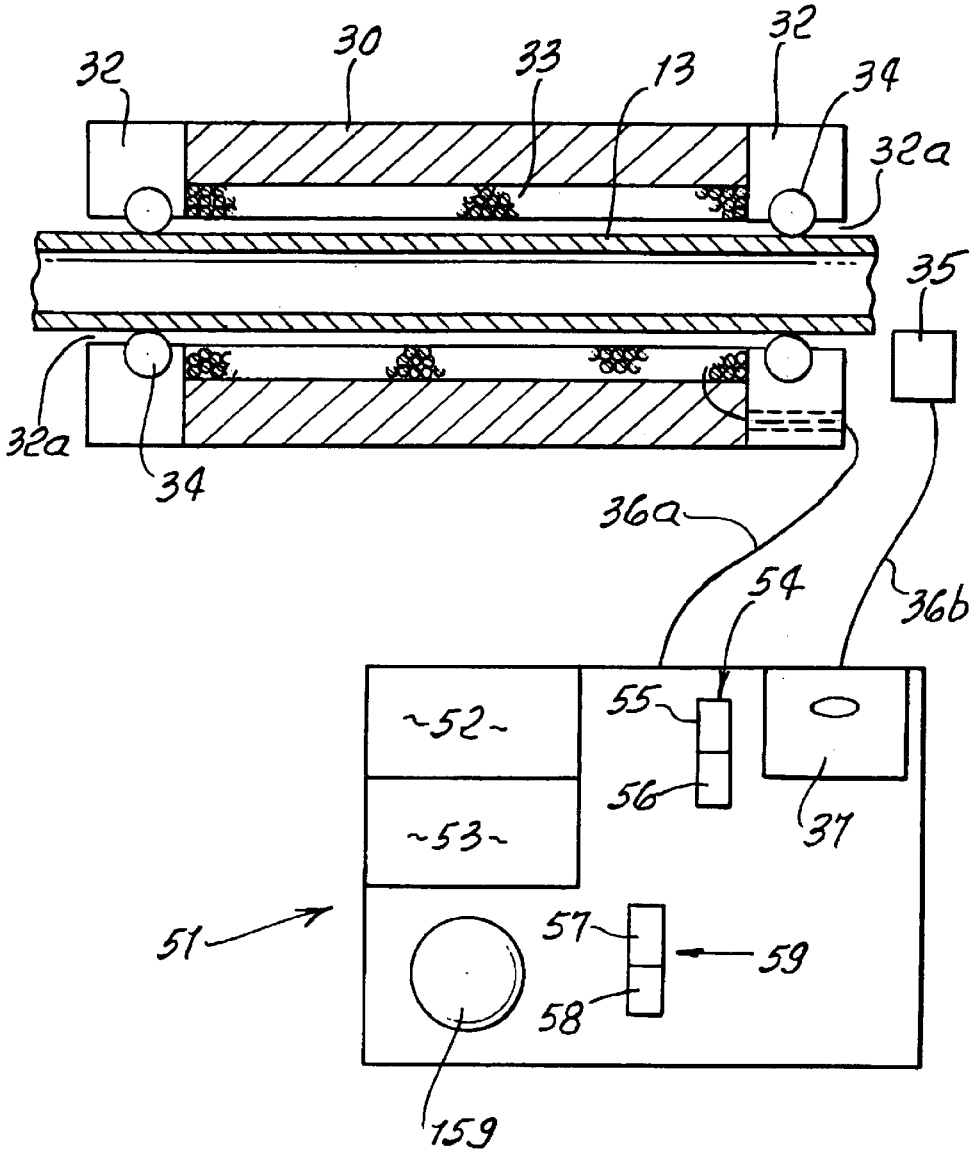
FIG. 5 shows an improvement to the magnetizing apparatus to provide for pole-strength measurement and feedback control of the achieved magnetization.

FIG. 5 shows an alternative power supply 51 that may be used with either of the coil structures of FIG. 3 of FIG. 4. Elements 30 through 37 are the same as shown and discussed in relation to FIG. 3 above. The power supply 51 includes a direct current source 52, an alternating current source 53, a selector switch 54, having positions 55 and 56, another selection switch 59 having positions 57 and 58. In some situations, it may be desirable to demagnetize casing segments that are to be adjacent to magnetized sections. This may be accomplished by selecting with switch 54 the direct current position 55 or an alternating current position 57. Use of alternating current transmitted to the coil effects demagnetization as the casing passes through the coil. Further, it may desirable to control the magnetization achieved in the casing section to a known and selected value. Switch 54 can select position 55 to engage a manual control of the direct current source 52 using control knob 159. In this case, the operator can read the indicated magnetic flux on the flux indicating meter 37 and manually adjust the direct current source 52 to supply direct current to a level such that the desired flux value is reached. This manual feedback control may be made automatic by selecting position 56 to directly connect the signal from the flux measuring device 35 to the direct current source 52. In this feedback mode of operation, the knob 159 can be used to set the desired flux value which is then automatically obtained.

In all of the above discussion, casing segments have been discussed as elements to be magnetized. All of the above applies equally well to the magnetization of drill pipe or any other wellbore tubular member that may be magnetized.

As stated above, it has been recognized that a useful magnetic field for intercept purposes was often available from some previous magnetic inspection of the casing or drill pipe sections. Apparatus described above is generally applicable in conjunction with magnetic inspection. Thus it is possible to specify certain values and limits to a casing-inspector, or contractor, and to achieve the desired casing magnetization described above as a byproduct of the casing inspection process.

As shown in FIG. 7, after the magnetized pipe or casing 70*a*, magnetized by any of the methods of this invention, is placed in a completed casing or pipe string 70 in the borehole, a magnetic measuring device 74 such as a set of three magnetometers, may be used to traverse the borehole regions of the magnetized sections as shown in FIG. 7. The measured magnetic field $F_1$ inside the completed casing has a direct and knowable relation to the field $F_2$ existing outside the casing in adjacent regions, as indicated by the expression $F_2=f(F_1)$. A magnetic field measuring device 74 is shown on a wire line 75, traversing the interior of magnetized section 70*a*. Thus a knowledge of the magnitude of the external field is obtained from such an internal measurement. Knowing the magnitude of the external magnetic field permits estimation of the range between an external magnetic field sensing apparatus and the casing. See circuitry 76 at the surface, connected with 74, and operable to provide such a range estimate, at readout 79. This is a direct estimate based solely on the magnitude information. Circuitry employed in conjunction with operation of 74 and 76 may include a magnetometer and a 16-bit A/D signal converter, for enhancing sensing of pipe section magnetization for improved accuracy and resolution at the readout 79, as referred to above. Device 74 is traveled in the bore near the polar end or ends 70*aa* and 70*aa*' of the magnetized pipe section, to detect same.

Referring now to FIG. 6*a*, casing string 160 is shown as installed in a well bore 161. The string includes casing sections 160*a* connected end to end, as at joint locations 160*b*. The sections are magnetized as described above, with positive + and negative − poles formed at the casing ends, as shown. Accordingly, the casing includes casing sections connected at joints, there being first and second sections having end portions of negative polarity connected at one joint, the second section connected with a third section, and having end portions of positive polarity connected at the next joint.

See in this regard casing end portions 163 and 164 of negative polarity, and the casing end portions 165 and 166 of positive polarity.

Referring now to FIG. 6*b*, it shows a series of magnetic measurements taken along a casing length, extending at an angle to vertical, in a well bore. There are four charts 6*b*-1, 6*b*-2, 6*b*-3, and 6*b*-4. Chart 6*b*-1 shows magnetic values in nanoTesla along the abcissa, and positions along the casing length, in feet, along the ordinate. Two runs are shown, one run shown in a solid line 170 and the other run shows in a broken line 171.

Chart **6*b*-1 is for magnetic measurements along the high side of the angled casing; chart 6*b*-2 is for magnetic measurements taken along the high side right dimension; chart 6*b*-3 is for magnetic measurements taken down hole; and chart 6*b*-4** is for a computed total of the first three chart measurements, at corresponding depth locations along the casing.

In this regard, the earth's field has been mathematically removed from the measured data.

We claim:

1. In the method of providing for well tubular member magnetization, the steps that include:

a) providing a magnetizing structure comprising an electrical coil defining an axis, an axially extending magnetic core associated with the coil, and annular pole pieces at opposite ends of the core, b) relatively displacing said member and said structure, with said pole pieces positioned and guided in close proximity to said member, and while supplying electric current to flow in said coil, thereby creating magnetic flux passage through said member, core, and pieces to magnetize said member or a part of said member, said coil and pole pieces guided by said member at locations spaced about said axis and proximate opposite ends of the coil and proximate the member, c) displacing said member in a wellbore, d) said member being magnetized as aforesaid while the member is displaced into said wellbore, and to a pole strength less than about 2,500 microweber, e) providing and operating a magnetometer sensor apparatus in a bore defined by said member, to detect magnetization of said member provided by said flux range, f) said apparatus provided to include a 16-bit analog to digital signal converter, for enhancing magnetization sensing accuracy and resolution, g) said member defining magnetized casing, and said method further including:

h) providing said magnetized casing within a well, to form a magnetic field $F_1$ within the casing, i) there being an external magnetic field $F_2$ outside the casing, said fields interacting, j) and measuring at least one of said interacting fields, for use in determining the other of the fields.

2. The method of claim 1 wherein the casing includes casing sections connected at joints, there being first and second sections having end portions of negative polarity connected at one joint, the second section connected with a third section, and having end portions of positive polarity connected at the next joint.

* * * * *